US006052875A

United States Patent [19]

Fudaki

[11] Patent Number: 6,052,875

[45] Date of Patent: Apr. 25, 2000

[54] BUCKLE ASSEMBLY

[75] Inventor: Tsutomu Fudaki, Kurobe, Japan

[73] Assignee: Yoshida Kogyo K.K., Tokyo, Japan

[21] Appl. No.: 08/173,715

[22] Filed: Dec. 9, 1993

Related U.S. Application Data

[63] Continuation of application No. 07/992,724, Dec. 18, 1992, abandoned.

[30] Foreign Application Priority Data

Dec. 20, 1991 [JP] Japan ..... 3-111277

[51] Int. Cl.[7] ..... A44B 11/25

[52] U.S. Cl. ..... 24/625; 24/615; 24/616; 24/640

[58] Field of Search ..... 24/625, 615, 616, 24/633, 606, 640

[56] References Cited

U.S. PATENT DOCUMENTS

| | | | |
|---|---|---|---|
| D. 341,105 | 11/1993 | Lovato . | |
| 874,957 | 12/1907 | Godley . | |
| 1,232,733 | 7/1917 | Swedlund | 24/616 |
| 3,167,835 | 2/1965 | Bengtsson . | |
| 4,150,464 | 4/1979 | Tracy . | |
| 4,171,555 | 10/1979 | Bakker et al. . | |
| 4,639,982 | 2/1987 | Kasai | 24/616 |
| 4,662,040 | 5/1987 | Terrell et al. . | |
| 4,672,725 | 6/1987 | Kasai . | |
| 4,679,282 | 7/1987 | Feng . | |
| 4,688,337 | 8/1987 | Dillner et al. | 24/616 |
| 4,689,861 | 9/1987 | Kopelowicz | 24/616 |
| 4,831,694 | 5/1989 | Kong | 24/625 |
| 4,991,272 | 2/1991 | Bianchi | 24/616 |
| 5,131,122 | 7/1992 | Lavato . | |
| 5,222,279 | 6/1993 | Frano et al. . | |

FOREIGN PATENT DOCUMENTS

| | | |
|---|---|---|
| 0 204 250 | 12/1986 | European Pat. Off. . |
| 2 582 487 | 5/1986 | France . |
| 56-53690 | 12/1981 | Japan . |
| 62-44649 | 11/1987 | Japan . |
| 216970 | 5/1990 | Japan . |
| 2 002 445 | 2/1979 | United Kingdom . |
| 2 165 299 | 4/1986 | United Kingdom . |

OTHER PUBLICATIONS

"Type V PKGD", ITW Nexus, Feb. 12, 1985. (One Page).

*Primary Examiner*—Victor N. Sakran
*Attorney, Agent, or Firm*—Hill & Simpson

[57] ABSTRACT

A buckle assembly comprises a plug member and a socket member releasably engageable therewith, the plug member having a pair of spaced resilient arms with engaging grooves and the socket member having engaging ridges formed in its upper and lower surfaces, the arrangement being that the engaging ridges in the socket member are releasably engageable with the corresponding grooves in the plug member at areas relatively close to the center of the buckle body and away from the sides thereof.

25 Claims, 3 Drawing Sheets

BUCKLE ASSEMBLY

This is a continuation, of application Ser. No. 07/992, 724, filed Dec. 18, 1992 now abandoned.

BACKGROUND OF THE INVENTION

1. Field of the Invention

This invention relates to a buckle assembly for use in releasably joining loose ends of belts or straps secured to garments, bags, helmets, sports gears and the like.

2. Prior Art

There are known numerous buckles or fastening devices of a two-piece structure comprising a male member and a female member releasably engageable therewith. For example in Japanese Utility Model Publication No. 62-44649 there, is disclosed a molded plastic buckle structure which comprises a female member in the form of a relatively flat cylindrical body having side apertures and a male member having a pair of laterally spaced resilient arms each including outwardly projecting finger press portions adapted to releasably lock with the corresponding side apertures in the female member.

Another somewhat similar buckle device is disclosed in Japanese Utility Model Publication No. 56-53690 in which the disclosed buckle is comprised of a female member; i.e. a flat receptacle body having concaved side apertures and a male member; i.e. an insert body having a pair of laterally spaced legs each provided at respective leading ends with hook-like projections for releasably engaging with the side apertures in the receptacle body.

Both of the above prior art buckle devices have a common design concept such that the area of interengagement between the male and the female member is located along both outer sides of the buckle body with the results that if the male member and the female member were disengaged from each other at one side of the buckle, there would be rotational or torsional torque developed at the other side of the buckle where the two members remain interengaged. Such rotational or torsional torque tends to increase more the farther the area of interengagement is located away from the center of the buckle, eventually causing separation between the male and female members and sometimes damage to the buckle.

SUMMARY OF THE INVENTION

With the foregoing drawbacks of the prior art in view, the present invention seeks to provide an improved buckle assembly which is substantially foolproof in operation and structurally stable.

More specifically, the invention seeks to provide a buckle assembly comprising a male or plug member and a female or socket member which are brought into and out of engagement with each other at points or areas in close proximity to the center of the buckle body such that rotational or torsional torque is held to an absolute minimum to preclude malfunctioning or damage of the buckle.

The above and other features and advantages of the invention will be better understood from reading the detailed description with reference to the accompanying drawings which illustrate by way of example a preferred embodiment of the invention.

According to the invention, there is provided a buckle assembly comprising a plug member and a socket member releasably engageable therewith, the plug member having a pair of parallel spaced resiliently deflectable arms each with an engaging groove located close to a central axis of the plug member, the arms each including a bulged side flange portion and a guide tongue, and the socket member having an upper plate and a lower plate joined together by surrounding side walls and defining therebetween a guide chamber for receptive engagement with the plug member, the side walls each having a slot for receiving the bulged flange portions to expose the latter to view, and the upper and lower plates each having an engaging ridge disposed in the chamber for locking engagement with the engaging groove in each of the arms.

DETAILED DESCRIPTION OF THE INVENTION

Figure 1:
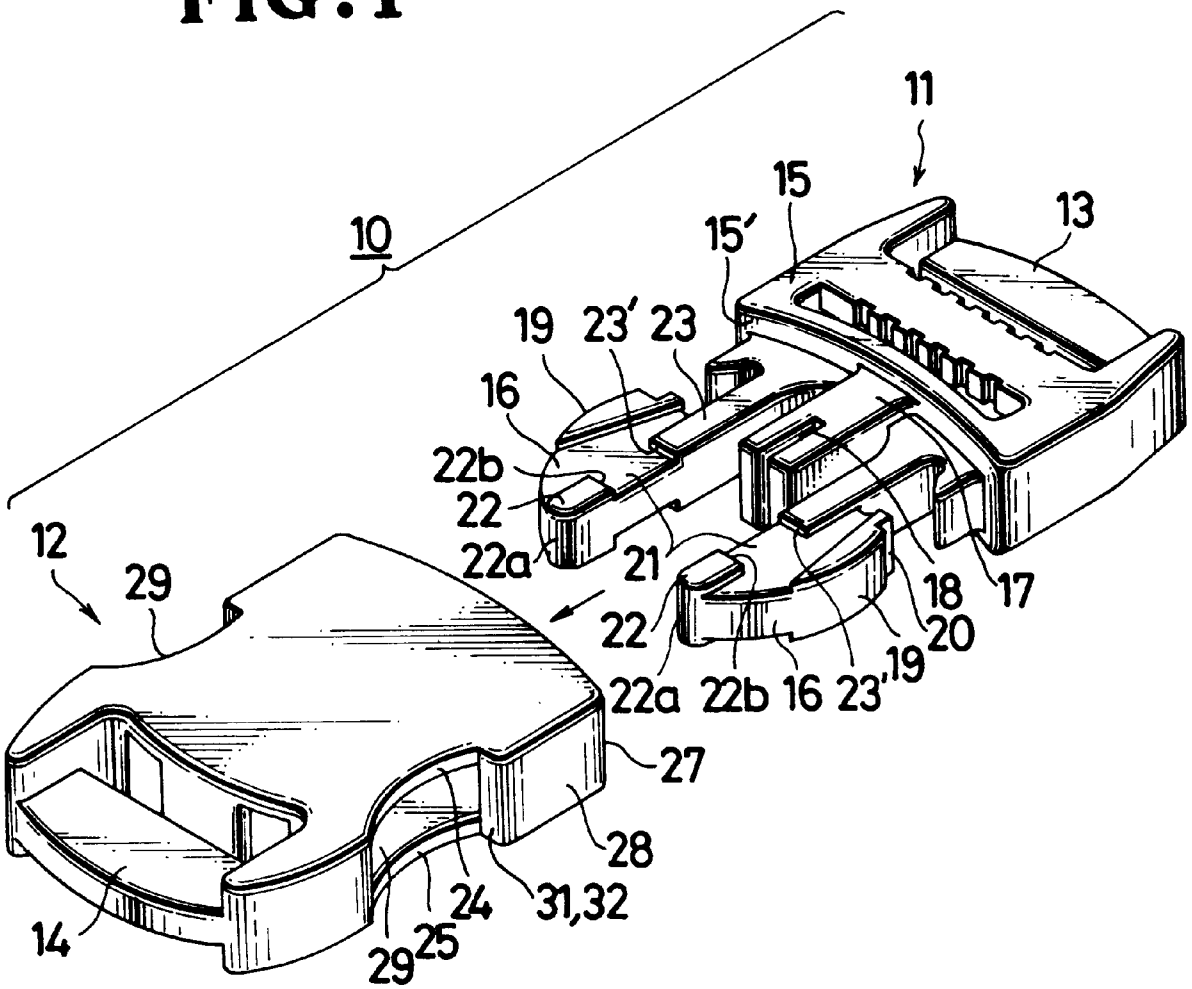
FIG. 1 is a perspective view of a buckle assembly embodying the invention shown in an uncoupled condition.

Referring now to the drawings and initially to FIG. 1, there is shown a buckle assembly 10 embodying the invention which is formed by injection or other suitable molding of a plastics material and which comprises a male latch member or plug member 11 and a female or socket member 12 releasably engageable therewith for connecting loose ends or extremities of a belt or like garment fasteners F (FIGS. 2 and 4) which are carried on engaging means 13, 14 provided on the respective buckle members 11, 12 in a manner well known in the art.

The male latch member or plug member 11 is generally in the form of a fork comprising a base 15, a pair of resiliently deflectable engaging arms 16, 16 extending in parallel spaced relation from an inner end 15' of the base 15 remote from the belt engaging means 13, and a neck 17 interposed centrally between the pair of arms 16, 16 and having an elongated guide slit 18. Each of the engaging arms 16, 16 has a bulged outer side flange portion 19 which tapers off at one or forward end thereof and which is recessed at the other or rear end to provide a locking lug 20 which forms an outwardly facing, upstanding wall surface. Each arm 16 is recessed to provide a pair of engaging grooves 21 in each of its upper and lower surfaces for lockingly receiving a corresponding pair of ridges in the socket member 12 in a manner hereinafter described. A guide tongue 22 is formed at a leading end of each of the arms 16, 16, merging with the tapered portion of the side flange portion 19. The guide tongue 22 has a ramp guide surface 22*a* diverging in the direction of insertion of the plug member 11 as indicated by an arrow in FIG. 1. The guide tongue 22 has in each of the upper and lower surfaces thereof an end wall 22*b* remote from the ramp surface 22*a*, which end wall 22*b* defines a transverse upstanding engaging wall surface or a latch surface of a latch means and the engaging groove 21 with a confronting end wall 23' of a straight guide portion 23 integral with each of the arms 16, 16.

The socket member 12 is generally in the form of a flat cylindrical box having an upper plate 24 and a lower plate 25 defining therebetween a guide chamber 26 for receptive engagement with the engaging arms 16, 16 of the plug member 11. The socket member 12 has an end opening 27 remote from the belt engaging means 14 and communicating with the guide chamber 26, through which opening 27 is inserted the engaging arms 16, 16. The upper and lower plates 24 and 25 are joined together by a pair of surrounding side walls 28, 28 which are centrally notched to provide respective slots 29, 29 in confronting relation communicating with the guide chamber 26.

Figure 2:
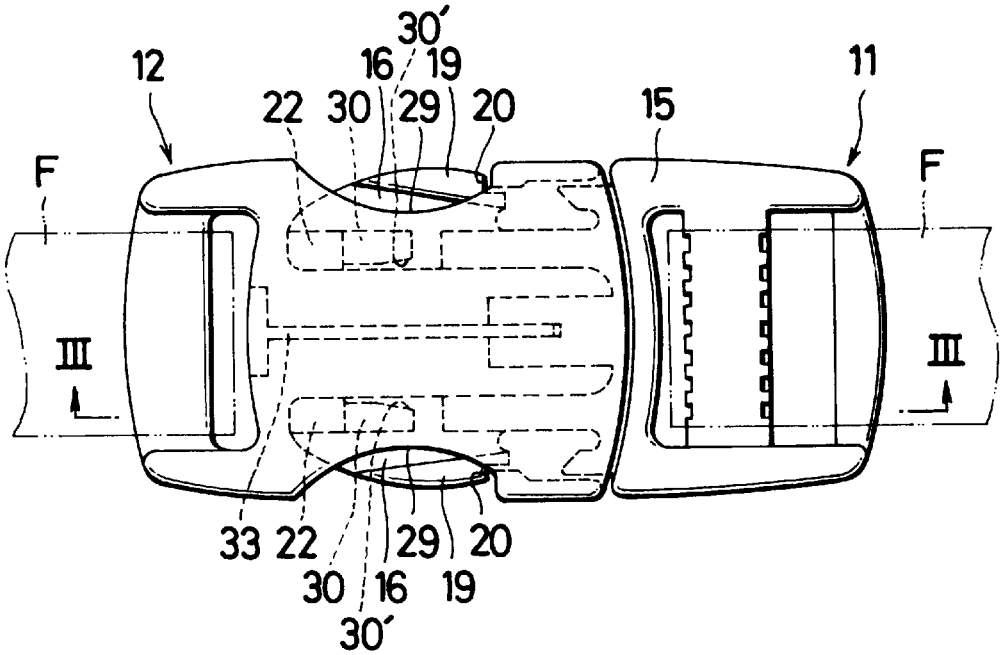
FIG. 2 is a plan view of the same shown in a coupled condition.
Figure 4:
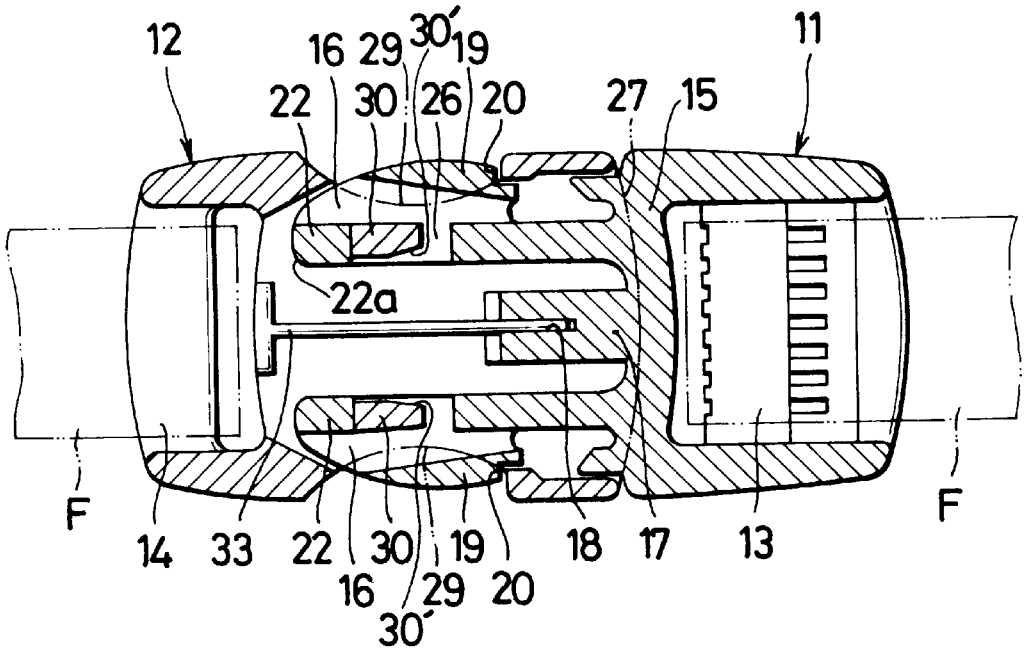
FIG. 4 a cross-sectional view taken generally along the line IV—IV of FIG. 3.

The slots 29, 29 each are dimensioned to fit with the bulged flange portion, 19 of the plug member 11 and extend arcuately into part of the upper and lower plates 24, 25 to present a concave profile such that the flange portion 19 is exposed to view when the buckle members 11, 12 are coupled together as shown in FIGS. 2 and 4. The socket member 12 is provided interiorly with a pair of guide ridges 30 each having a ramp surface 30' diverging in the direction of reception of the plug member 11 symmetrically with the ramp surface 22*a* of the guide tongue 22 and extending in confronting relation from each of the upper and lower plates 24, 25 at positions to register with the corresponding pair of engaging grooves 21. The ridges 30 form the engaging ridges with transversely engaging surfaces that engage the wall surfaces 22*b* of the grooves 21. The slots 29, 29 each terminate at a cut-out vertical side wall portion 31 which serves as an engaging abutment engaging surface 32 for locking engagement with the locking lug 20 of the plug member 11. The socket member 12 is further provided interiorly with a support bar 33 extending centrally between and interconnecting the upper and lower plates 24 and 25 and having a leading end portion for fitting engagement with the guide slit 18 in the plug member 11 to provide increased strength of coupling between the buckle members 11, 12.

With this construction, the buckle assembly 10 of the invention is brought into coupled condition by inserting the engaging arms 16, 16 of the plug member 11 through the end opening 27 in the socket member 12, in which instance the arms 16, 16 are resiliently deflected inwardly toward each other as the bulged side flange portions 19 slidingly engage with the inner side walls of the socket member 12.

Figure 3:
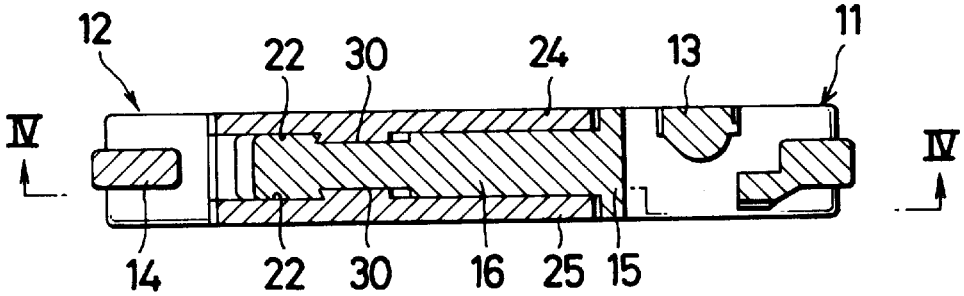
FIG. 3 is a cross-sectional view taken generally along the line III—III of FIG. 2.

At a certain point of progressive insertion, the guide tongue 22 of the plug member 11 and the guide ridges 30, 30 of the socket member 12 are brought into sliding engagement along their respective ramp surfaces 22*a* and 30' until the ridges 30, 30 register with and snap into the corresponding guide grooves 21, 21 in the plug member 11 by the action of elastic return of the arms 16, 16 to normal undeflected position where the bulged flange portions 19 of the respective arms 16, 16 are released from pressure engagement with the inner walls of the socket member 12 and exposed to view through the slots 29, 29 as shown in FIGS. 2, 3 and 4. In this coupled condition of the buckle assembly 10, the locking lug 20 of the plug member 11 is lockingly engaged with the abutment 32 of the socket member 12, with the support bar 33 received in the guide slit 18 as better shown in FIG. 4.

The buckle members 11 and 12 are disengaged by depressing the bulged flange portions 19, 19 of the plug member 11 inwardly toward each other, whereupon the guide ridges 30, 30 are released from the guide grooves 21, 21, and the engaging abutment 32 from the locking lug 20, allowing the plug member 11 to be pulled out.

Since the interengagement of the buckle members 11, 12 is effected mainly by the cooperation of the ridges 30, 30 and the grooves 21, 21 which are located rather close to a longitudinal center axis of the buckle assembly 10 away from the lateral sides thereof, the buckle assembly 10 of the invention is held substantially free from the effect of rotational or torsional torque which would otherwise cause inadvertent separation or even damage of the buckle members 11, 12.

Obviously, various modifications and variations of the present invention are possible in light of the above teaching. It is therefore to be understood that within the scope of the appended claims the invention may be practiced otherwise than as specifically described.

What is claimed is:

1. A buckle assembly comprising a plug member and a socket member releasably engageable therewith, said plug member having a pair of parallel spaced resiliently deflectable arms each with an engaging groove located close to a central axis of said plug member, said arms each including a bulged side flange portion and a guide tongue, and said socket member having an upper plate and a lower plate joined together by surrounding side walls and defining therebetween a guide chamber for receptive engagement with said plug member, said side walls each having a slot for receiving said bulged flange portions to expose the latter to view, and said upper and lower plates each having an engaging ridge disposed in said chamber for locking engagement with said engaging groove in each of said arms.

2. A buckle assembly according to claim 1 wherein said guide tongue has a ramp surface diverging in the direction of insertion of said plug member.

3. A buckle assembly according to claim 1 wherein said engaging ridge has a ramp surface diverging in the direction of reception of said plug member.

4. A buckle assembly according to claim 1 wherein each of said arms has a locking lug formed remote from said guide tongue, and each of said side walls has an engaging abutment for locking engagement with said locking lug.

5. A buckle assembly according to claim 1 wherein said plug member is provided with a guide slit interposed between said arms, and said socket member has a support bar interconnecting said upper and lower plates and adapted to be received in said guide slit.

6. A buckle, comprising:

a female receptacle member comprising a tubular body, an interior channel extending therethrough and open at one end thereof, and engagement means defined within said tubular body;

a male latch member having at least one arm member for insertion within said interior channel of said tubular body through said open end of said interior channel of said tubular body of said female receptacle member, said at least one arm member having a predetermined lateral width extending from a laterally outward position to a laterally inward position with respect to said interior channel of said tubular body, and a longitudinal axis extending longitudinally through said at least one arm member; and latch means disposed upon said at least one arm member for releasable locking engagement with said engagement means of said tubular body upon insertion of said at least one arm member within said interior channel of said tubular body, said latch means of said at least one arm member having a predetermined width, extending from a laterally outward position to a laterally inward position with respect to said interior channel of said tubular body, and a disposition upon said at least one arm member such that a longitudinal axis of said latch means coincides with said longitudinal axis of said at least one arm, as considered in said width direction, so as to provide a retaining force acting along said longitudinal axis of said latch means, in opposition to and alignment with an arm member removal load force, as considered in said width direction, acting along said longitudinal axis of said at least one arm member.

7. The buckle as defined in claim 6, wherein said engagement means includes an engagement member formed within said channel and said latch means comprises a shoulder formed proximate a distal end of said arm member, said engagement means providing inward deflection of said arm member with respect to said channel by said engagement member upon insertion of said arm member within said channel until said arm member clears said engagement member and flexes in a first direction toward the exterior of said channel to obtain a locked position, said shoulder being formed on a surface of said arm member, said surface facing a second direction substantially perpendicular to said first direction to provide said alignment of forces.

8. The buckle as defined in claim 7, including an aperture through said tubular body proximate said engagement member to provide access to said arm member from the exterior of said tubular body for release of said arm member from said engagement member.

9. A buckle as set forth in claim 7, wherein:

said engagement member of said engagement means including a ramped surface for providing said inward deflection of said at least one arm member upon insertion of said at least one arm member within said interior channel of said tubular body.

10. The buckle as defined in claim 7, wherein said engagement member and said latch shoulder are formed at cooperating complementary angles so as to provide increased holding power and prevent premature release of said buckle under load.

11. A buckle as set forth in claim 6, wherein:

said at least one arm member comprises a pair of laterally spaced arm members.

12. A buckle as set forth in claim 6, further comprising:

means defined upon both of said female receptacle and male latch members for securing ends of webs thereto whereby said ends of said webs are able to be connected together by said buckle.

13. A buckle comprising:

a female receptacle member comprising a substantially flat tubular body, having an interior channel extending therethrough, formed by two opposed top and bottom walls and two opposed side walls, said top and bottom walls being wider than said side walls, said tubular body having a predetermined length and being open to said channel on at least one end thereof;

a male latch member having at least one longitudinally extending and substantially flexible arm member for insertion into said interior channel of said female receptacle member through said open end of the female receptacle member, said at least one arm member having a predetermined lateral width extending from a laterally outward position to a laterally inward position with respect to said interior channel of said tubular body and in a direction extending between said side walls of said tubular body;

engagement means defined within said tubular body; and latch means disposed upon said at least one arm member for releasable locking engagement with said engagement means of said tubular body, said latch means being accessible from the exterior of said tubular body for releasable engagement from said engagement means of said tubular body by a user, and said latch means comprising latch surfaces disposed upon opposite sides of said at least one arm member so as to extend toward both said top and bottom walls of said tubular body, said latch surfaces also having predetermined lateral width dimensions which correspond to said predetermined lateral width of said at least one arm member.

14. A buckle as defined in claim 13, wherein said engagement means include an engagement member formed with both of said top and bottom walls and said latch means of said arm member includes a pair of engagement shoulders, one each formed on opposite sides of said arm member for cooperative engagement with said engagement members of said top and bottom surfaces.

15. The buckle as defined in claim 14, including an aperture formed through said tubular body proximate at least one of said engagement members to provide access to said arm member from the exterior of said tubular body for release of said arm member from said engagement members.

16. The buckle as defined in claim 13, wherein said engagement members and said engagement shoulders are formed at cooperating complementary angles to provide increased holding power and prevent premature release of the buckle when under load.

17. A buckle as set forth in claim 13, wherein:

said at least one arm member comprises a pair of laterally spaced arm members.

18. A buckle as set forth in claim 17, further comprising:

aperture means defined within both of said opposed side walls of said tubular body for providing access to said pair of laterally spaced arm members from the exterior of said tubular body so as to permit said pair of laterally spaced arm members to be released from said engagement means of said tubular body.

19. A buckle as set forth in claim 13, further comprising:

means defined upon both of said female receptacle and male latch members for securing ends of webs thereto whereby said ends of said webs are able to be connected together by said buckle.

20. A buckle assembly comprising a plug member and a socket member releasably engageable therewith, said plug member having a pair of transversely spaced resiliently deflectable arms, said arms each including a transversely outwardly bulged side flange portion, and said socket member having an upper plate and a lower plate joined together by surrounding side walls and defining therebetween a guide chamber for receptive engagement with said plug member, said side walls each having a slot for receiving said bulged flange portions to expose the latter to view, said arms each having a transverse upstanding engaging wall surface on the top and bottoms thereof, and said upper and lower plates each having an engaging ridge transversely disposed on said chamber inwardly of said side walls and projecting vertically providing locking engagement with said engaging wall surface on each of said arms.

21. A buckle assembly comprising a plug member and a socket member releasably engageable therewith, said plug member having a pair of transversely spaced resiliently deflectable arms, said arms each including a transversely outwardly bulged side flange portion, and said socket member having an upper plate and a lower plate joined together by surrounding side walls and defining therebetween a guide chamber for receptive engagement with said plug member, said side walls each having a slot for receiving said bulged flange portions to expose the latter to view, said arms each having a transverse upstanding engaging wall surfaces on the top, bottom and outer sides, and said upper and lower plates each having an engaging ridge transversely disposed on said chamber inwardly of said side walls and projecting vertically providing locking engagement with said engaging wall surface on the top and bottom sides of each of said arms and the surrounding side walls each having a transversely extending wall surface providing locking with the wall surface on the respective outer side of each of said arms.

22. A buckle assembly comprising a plug member and a socket member releasably engageable therewith, said plug member having a pair of spaced resiliently deflectable arms, said arms each including a transversely outwardly bulged side flange portion surface, and said socket member having an upper plate and a lower plate joined together by surrounding side walls and defining therebetween a guide chamber for receptive engagement with said plug member, said side walls each having a slot for receiving said bulged flange portions to expose the latter to view, said arms each having a transverse upstanding engaging wall surface substantially across the top and bottoms thereof, and said upper and lower plates each having an engaging surface transversely disposed on said chamber inwardly of said side walls and projecting vertically providing locking engagement with said engaging wall surface on each of said arms.

23. A buckle assembly comprising a plug member and a socket member releasably engageable therewith, said plug member having a pair of spaced resiliently deflectable arms, said arms each including a transversely outwardly bulged side flange portion surface, and said socket member having an upper plate and a lower plate joined together by surrounding side walls and defining therebetween a guide chamber for receptive engagement with said plug member, said side walls each having a slot for receiving said bulged flange portions to expose the latter to view, said arms each having a transverse upstanding engaging wall surface substantially across the top and bottoms thereof, and said upper and lower plates each having an engaging surface transversely disposed on said chamber inwardly of said side walls and projecting vertically providing locking engagement with said engaging wall surface on each of said arms, said arms each having an outwardly facing, upstanding engaging wall surface for engaging an engaging surface on the adjacent side wall.

24. A buckle comprising:

a female receptacle member comprising a substantially flat tubular body, having an interior channel extending therethrough, formed by two opposed top and bottom walls and two opposed side walls, said top and bottom walls being wider than said side walls, said tubular body having a predetermined length and being open to said channel on at least one end thereof;

a male latch member having a pair of longitudinally extending and substantially flexible arm members for insertion into said interior channel of said female receptacle member through said open end of the female receptacle member, each of said arm members having a predetermined lateral width extending from a laterally outward position to a laterally inward position with respect to said interior channel of said tubular body and in a direction extending between said side walls of said tubular body;

engagement means defined within said tubular body projecting into the interior channel from each of the said top and bottom walls; and latch means disposed upon each of said arm members for releasable locking engagement with said engagement means of said tubular body, said flexible arm members being accessible from the exterior of said tubular body for releasable engagement of said latch means from said engagement means of said tubular body by a user, and said latch means comprising latch surfaces disposed upon said arm members and extending toward both said top and bottom walls of said tubular body, said latch surfaces also having predetermined lateral width dimensions which permit lateral by-passing of said projecting engagement means upon flexing said arm members.

25. A buckle comprising:

a female receptacle member comprising a substantially flat tubular body, having an interior channel extending therethrough, formed by two opposed top and bottom walls and two opposed side walls, said top and bottom walls being wider than said side walls, said tubular body having a predetermined length and being open to said channel on at least one end thereof;

a male latch member having a pair of longitudinally extending and substantially flexible arm members for insertion into said interior channel of said female receptacle member through said open end of the female receptacle member, said arm members having a predetermined lateral width extending from a laterally outward position to a laterally inward position with respect to said interior channel of said tubular body and in a direction extending between said side walls of said tubular body;

engagement means defined on said tubular body; and latch means disposed upon each of said arm members for releasable locking engagement with said engagement means of said tubular body, said flexible arm members accessible from the exterior of said tubular body for releasable engagement of said latch means from said engagement means of said tubular body by a user, and said latch means comprising latch surfaces disposed upon said arm members and extending toward both said top and bottom walls of said tubular body, said latch surfaces also having predetermined lateral width dimensions which extend substantially the said predetermined lateral width of said arm member.

* * * * *

UNITED STATES PATENT AND TRADEMARK OFFICE

CERTIFICATE OF CORRECTION

PATENT NO : 6,052,875

DATED : April 25, 2000

INVENTOR(S) : Fudaki

It is certified that error appears in the above-identified patent and that said Letters Patent is hereby corrected as shown below:

Title page, item [73]

Please change the Assignee from "Yoshida Kogyo K.K., Tokyo, Japan"

to --YKK Corporation, Tokyo, Japan--.

Signed and Sealed this

Twenty-ninth Day of August, 2000

*Attest:*

*Attesting Officer*

Q. TODD DICKINSON

*Director of Patents and Trademarks*